United States Patent [19]

Williner

[11] Patent Number: 4,495,713

[45] Date of Patent: Jan. 29, 1985

[54] INFRARED DRYING FOR WATER-IMPREGNATED PHOTOGRAPHIC FILMS

[75] Inventor: Mario Williner, Ferrania, Italy

[73] Assignee: Minnesota Mining and Manufacturing Company, St. Paul, Minn.

[21] Appl. No.: 385,048

[22] Filed: Jun. 4, 1982

[30] Foreign Application Priority Data

Jun. 19, 1981 [IT] Italy ..... 48720 A/81

[51] Int. Cl.[3] ..... F26B 23/04

[52] U.S. Cl. ..... 34/68; 34/4; 34/41; 34/48

[58] Field of Search ..... 34/4, 41, 48, 68, 155

[56] References Cited

U.S. PATENT DOCUMENTS

| | | | |
|---|---|---|---|
| 2,705,137 | 3/1955 | Haltmeier | 34/48 |
| 3,720,002 | 3/1973 | Martin | 34/41 |
| 3,900,959 | 8/1975 | Breschi et al. | 34/155 |
| 4,085,309 | 4/1978 | Godel et al. | 34/48 |

*Primary Examiner*—Larry I. Schwartz

*Attorney, Agent, or Firm*—Donald M. Sell; James A. Smith; Mark A. Litman

[57] ABSTRACT

Energy is saved during the drying of radiographic films by infra-red radiation devices if their power is automatically varied in accordance with temperature measurements taken on circulating air. Such devices are particularly useful if incorporated into aqueous bath photographic processing machines which are followed by a drying chamber.

9 Claims, 7 Drawing Figures

INFRARED DRYING FOR WATER-IMPREGNATED PHOTOGRAPHIC FILMS

TECHNICAL FIELD

This invention relates to a new device for drying a water-impregnated photographic film and a photographic processing machine, particularly radiographic or graphic art machines which include said device.

BACKGROUND OF THE ART

An exposed photographic film is known to be subjected to photographic processing baths, such as for example for developing, fixing and washing with water in the case of a radiographic film, and is then dried to remove the impregnating water after processing.

It is also known that this drying process is a critical stage in the entire photographic process, to the extent that it influences the quality of the final image obtained. It can be carried out either inside drying chambers into which high temperature air is blown, or by passing the film through them if they are provided with and conveying means which are normally disposed at least partially inside the chambers themselves. These conveying means generally consist of rollers which rotate about their axis and which by rotating cause a film in contact with them to move along the conveying plane determined by the points of contact between said rollers and the film. In particular, said rollers can be disposed in series either opposing or offset, as described for example in U.S. Pat. No. 3,025,779.

A conveying device of the second type generally includes a fan which blows air towards a heat source and then on to both the faces of the film to be dried while it passes through the drying chamber. The hot air flow dries the film more rapidly the higher the temperature of the air blown on to the film (the hot air source being either a conventional electric heating element or a different heat source such as an infra-red ray source as described in British Pat. No. 1,131,681). Temperature of said hot air is normally at 50° to 70° C.

Alternatively, such devices include infra-red radiation sources, placed close to the film so as to directly irradiate it with infra-red rays, combined with non-heated air, the flow of which is induced by fan means and both cools the film and takes away the moisture evaporated from the film, as described in U.S. Pat. No. 3,900,959.

It is considered that the second aforesaid type of device represents an advancement in the art of drying a water-impregnated photographic film, but it is also considered that a further advance can be made to attain a drying device which adds efficiency and smoothness of operation, as well as processing latitude, to operational economy.

SUMMARY OF THE INVENTION

In developing the present invention applicant used a commercially available machine which comprised a probe for measuring the temperature in the drying chamber, sensor means at the inlet which indicated the presence of film in the machine, infra-red lamps which were provided with on-off controls (as described in greater detail hereinafter), means for varying the machine speed and means for measuring this latter, each of said measurement and control means being associated with a microprocessor.

The basic idea was that the lamps should be turned off (or on) automatically when the temperature of the air in the drying chamber was above (or below) a predetermined value. However, this idea had been the basis of many unsuccessful attempts in which the film left the drying chamber with portions still wet.

It was feared that there might be a basic error in attempting to adjust the power of the infra-red ray sources in accordance with a measurement of the temperature of the air, this latter being considered, at the temperature concerned, to be an unsubstantial part of the drying process (effected mainly by the infra-red rays). On the contrary, when the drying of the film is made through heated air, the air heaters, as known, may be switched on and off to maintain the drying temperature at prefixed values, for example between 50° and 70° C.

The fact of having a microprocessor for controlling the power of the lamps by turning them on and off by progressive variations in the power using a burst in the main frequency (the frequency of the externally applied voltage), which was introduced by the applicant in order to prevent shocks to the infra-red ray sources, enabled a limit to be set on the reduction in the power of the infra-red ray sources for temperature measurements exceeding a determined value. This modification enables the drying of the photographic films to be carried out in accordance with the present invention.

In this respect, according to the present invention, it was found that good drying results can be obtained with an average operating power applied to the infra-red ray sources which is significantly lower than normal if the power is controlled by a temperature measuring device within the drying chamber such that the power is increased for temperatures below a predetermined working temperature and decreased for temperatures above said temperature, provided such decreases do not result in a power less than a minimum power threshold which, when applied to said sources, is sufficient to dry the film at an air temperature corresponding to said predetermined temperature value.

In other words, by combining air at a certain temperature itself insufficient to dry a photographic film, with infra-red rays emitted at a certain minimum power, the film is dried if this power is increased by automatic devices for each measured decrease of said temperature.

This "minimum" power is defined as that which is sufficient to dry the considered film (or the most critical film in the case of a plurality of films) at the set working temperature (but presumably also at actual working temperatures less than that by a value corresponding to the thermal inertia of the machine and of the processed films, for example within a range approximately evaluated at about 1° centigrade for the machines and the films of the applicant).

DETAILED DESCRIPTION

Figure 1:
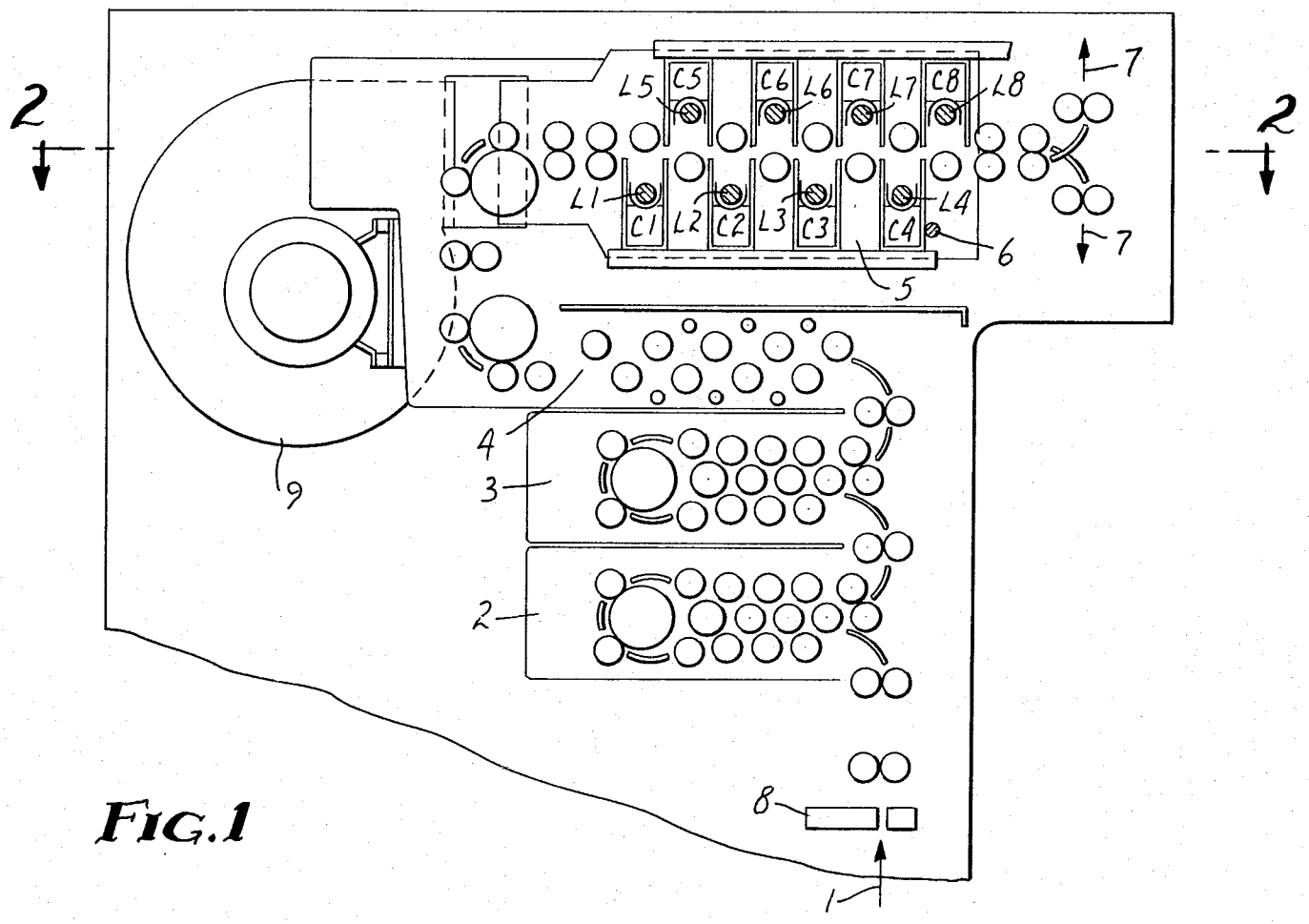
FIG. 1 shows a longitudinal section of the apparatus of the present invention.

The present invention relates in particular to a drying device for a water-impregnated photographic film comprising a drying chamber provided with an inlet and outlet, film conveying means disposed at least partly inside said chamber, infra-red ray sources of elongated shape (the use of infrared ray lamps elongated in shape is believed to be essential to the purposes of the present invention to continuously irradiate the whole area of the film to dry while it passes through the drying chamber) directed towards the conveying plane of the film and means for circulating air within said drying chamber, characterised in that it includes:

(a) means for measuring the temperature of the air circulating within the drying chamber;

(b) means for varying the electrical power applied to the infrared ray sources (without changing the voltage supplied to them);

(c) means which, depending on the result of said measurement of the air temperature, increase or decrease the applied power according to whether the measured temperature is respectively less or greater than a predetermined value, any downward variation in the power, when a film to be dried is present, being such as not to result in power values which are less than a certain minimum threshold power value which, when combined with air at the actual working temperature, is able to dry said film.

Preferably, the present invention relates to a drying device as heretofore described wherein said predetermined drying temperature lies between 35° and 40° C., and more preferably around 38° C.

Preferably, and in particular, the present invention relates to a drying device as heretofore described wherein the total potential power output of the infrared lamps which constitute said sources corresponds approximately to a power which is double said minimum power threshold supplied to the lamps.

According to a further less particularly preferred aspect, the present invention relates to a device as heretofore described wherein the minimum power lies between 30 and 80% of the maximum.

The present invention relates in particular to a processing machine for photographic films, preferably sheet photographic films for use in radiography and graphic arts, which comprises a plurality of sections for processing said films in aqueous solution (including water wash), and a subsequent drying section, characterized by being constituted by a device as heretofore described.

Preferably, said machine comprises means which enable the temperature in the drying chamber to be compared with two different temperature values, the lower corresponding to that temperature existing in the absence of film and defined as the stand-by temperature of the machine, and the higher corresponding to that temperature existing in the presence of film in the machine and defined as the working or drying temperature.

As indicated heretofore, the set working temperature is chosen as that which enables the chamber air (at its actual temperature) together with the infra-red ray sources at their prechosen threshold power to dry the film, whereas the machine stand-by temperature is chosen at a lower temperature such that said working temperature can be attained by the radiation from the infra-red ray sources during the time used by the film in passing from the machine inlet, through said processing sections, and to the drying section (depending on the machine speed).

When the device is employed in a processing machine, the number of lamps to be used for the purposes of the present invention, together with their power, obviously vary according to the machine characteristics, such as for example the film speed and the thermal inertia characteristics of the drying chamber. They also vary according to the films to be processed in the machine, and to the external air temperature. For the purposes of the present invention, it was required to construct a drying device which was able, with certainty and in the desired manner, to dry each of the various radiographic films available commercially in their various formats and various exposure and hardening conditions (and more generally with reference to their various water contents). Particular variations in conditions of application of the present invention described in the examples can be readily determined by the ordinarily skilled artisan.

The present invention can either be applied to already existing machines with a predetermined speed and number of lamps, to give considerable energy saving, or can be used during the design of new processing machines.

From the description given hereinafter, it will be noted that it is not essential to provide a microprocessor in the machine in order to gain advantage from the results of the present invention, it being sufficient to arrange, even by conventional means, to control the power applied to the infra-red lamps in accordance with temperature measurements, and to predetermine minimum power and drying temperature threshold, as described.

The ordinarily skilled artisan will obviously be able to chose the working temperature, the stand-by temperature, and the maximum and minimum lamp power on the basis of the characteristics of his own machine and of the films to be dried.

From certain results of the work carried out in connection with the present invention, it is considered necessary to advise the expert of the art to take account of the variables connected with thermal inertia of the system in his attempts to find the best compromise between good technical results and machine economy.

In particular, in determining the maximum lamp power relative to the minimum lamp power for a predetermined working temperature, the artisan must consider not only the fact that the reserve of excess power over the threshold power is able to be used to raise the stand-by temperature to the working temperature in a predetermined time, but also the fact that this reserve of power is able to readily oppose the system inertia when the working temperature tends to fall below the predetermined value.

As already indicated, the system response to temperature changes must be such that the actual working temperature does not vary excessively from the set temperature. This depends significantly on the ratio of the minimum power to the maximum power available, the minimum power, as stated, being preferably between 30 and 80% of the maximum power, and more preferably around 50%.

It is also preferable for the minimum power and/or working temperature to be able to be varied in order to be able to match the drying characteristics of the device according to the present invention to variations in conditions, particularly to variations in the water content of the films or in their speed of passage through the device. For example, 3M x-ray films for use in radiology such as type H, type XD, type R and type S films have different water contents respectively of 15 up to 35 grams per square meter.

In any case, it appears to have been established that the use of the present invention allows considerable savings in the consumption of energy used for drying photographic films.

The infra-red radiation sources of the present invention are preferably high temperature tungsten quartz lamps with a color similar to that of the lamps used in photoreproduction systems, such as the Toshiba QIR lamps, the Philips 13381 lamps, the General Electric Infra-red lamps, or the Original lamps of Hanau Quarzen Lampen.

Their distance from the film conveying plane must be chosen such as to enable the infra-red rays both to directly irradiate the film without much air between, and to act on the temperature of the air-itself. A distance of about 3 cm appears advisable, but greater of lesser distances (for example 2 to 4 cm) can be chosen without prejudicing the operation of the device according to the present invention.

The present invention is described hereinafter with data which illustrate experiments describing the present invention, with reference to FIGS. 1, 2, 3, 4 and 5, which respectively illustrate the processing machine overall (FIGS. 1 and 2), the block diagram describing the operation of the drying section, the flow chart describing the method of operation of the CPU (Central Processor Unit) or microprocessor, and the electrical schematic diagram which describes the operation of a drying section controlled by conventional means (without computer). Before describing the aforesaid figures and certain experiments carried out with the described machines, a description will be given on the methods used for varying the power of the infra-red lamps while maintaining them at a voltage close to the rated or main voltage.

Using a burst in the main frequency, the sinusoidal electric current trains were splitted up, at their real voltage, by sampling successive bunches each having a fixed number of waves or periods, for example 10, and means were disposed for distinguishing, within each bunch, a number of "on" periods during which the lamps were supplied and a number of "off" periods in which the supply current was excluded from the lamp, while maintaining the on+off value fixed, for example equal to 10. Thus, supposing the supply voltage to be constant, it was assumed to be able to vary the power linearly (by said splitting-up of the main frequency into bunches of 10 periods) from 0 to 100% by steps of 10%.

Considering a main frequency of 50 Hz (or 60 Hz), the period T is equal to 20 ms (or 16.6 ms). If $T_{on}$ is defined as the time during which power is supplied to the lamps, and $T_{off}$ is defined as the time during which supply current is excluded from the lamps, a cycle time $Tc=T_{on}+T_{off}=200$ ms (or 166 ms) is obtained. This value proved to be a good compromise between the need for short cycles, for drying efficiency reasons, and the facility for lighting and extinguishing the lamps with moderation coinciding with the possibility of graduating the power. The cycles can obviously either be shorter or longer for the purposes of the present invention, provided the long cycles are not so long as not to enable the film to continuously absorb the energy supplied to it intermittently, and provided the short cycles do not introduce excessive rigidity into the system. In particular, for the purposes of the present invention it must be assumed that the infra-red power is absorbed by the film as average power (when speaking of infra-red lamp power herein, its average value is intended).

It should also be noted that the main frequency burst with passage through zero and the "on" and "off" periods beginning and terminating when the voltage passes through zero (and when the derivative is positive) not only enables discontinuities in the current passage and thus radiofrequency disturbances to be prevented, but also enables the means concerned with the programmed lighting of the lamps to be controlled simply by means of a zero cross detector.

Figure 2:
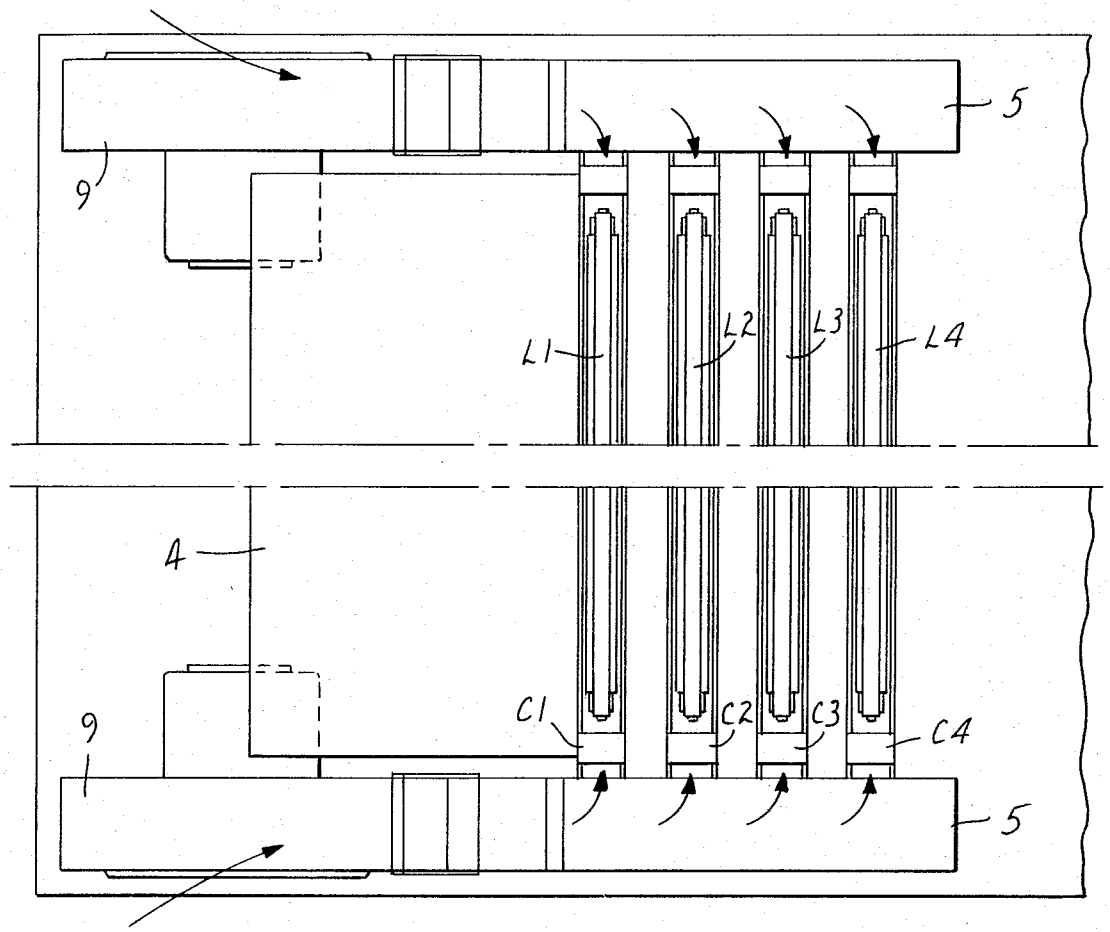
FIG. 2 shows a vertical section of the apparatus of the present invention.

FIG. 1 is a longitudinal section through a radiographic processing machine according to the present invention. FIG. 2 is a part section on the line A—A through the machine of FIG. 1, with particular reference to the drying means but excluding the conveying means. In said FIGS. 1 and 2, the reference numeral 1 indicates the film inlet, 2 the development section, 3 the fixing section, 4 the wash section, 5 the drying section, 6 the air temperature probe, 7 the film outlet, 8 the inlet film photoreader, and 9 the fan. The symbols L1 to L8 indicate the infra-red lamps, and the symbols C1 to C8 indicate the conduits which distribute air to the film. A variable number of said lamps could be switched in, in order to vary both the maximum available power and the lamp position. The machine was characterized by the following parameters:

| | |
|---|---|
| length of the entire machine measured in terms of the film path | 2300 mm |
| length of the drying chamber | 252 mm |
| maximum number of applicable lamps | 8 |
| type of IR lamps (Original Hanau Quarzen Lampen) | 550 W/110 V |
| number of fans | 2 |
| working head | 10 mm $H_2O$ |
| throughput of each fan (at 20 mm/$H_2O$) | 200 $m^3$/hr |
| supply voltage (across 4 lamps connected together in series pairs) | 220 Volts |

Figure 3:
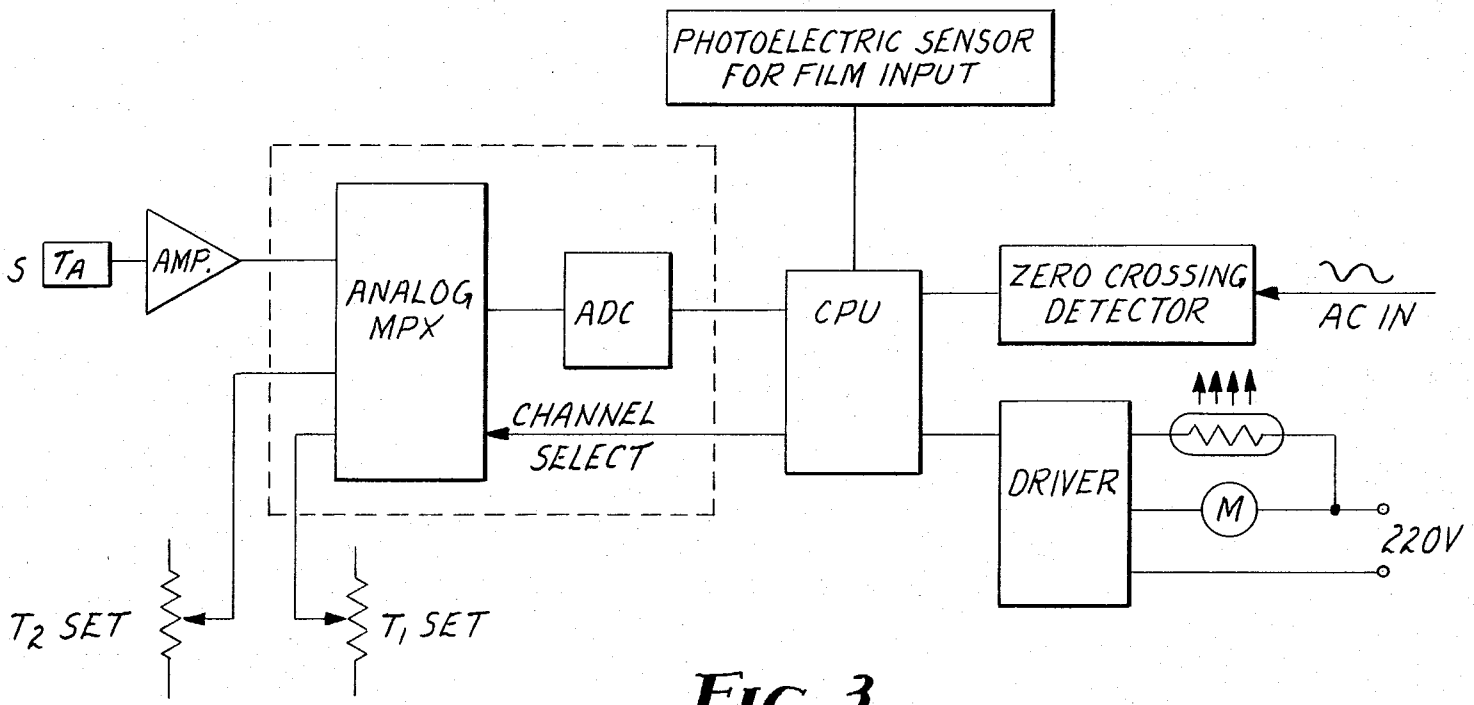
FIG. 3 shows a block diagram of the probe, amplifier, input signal sampler and analog converter.
Figure 4A:
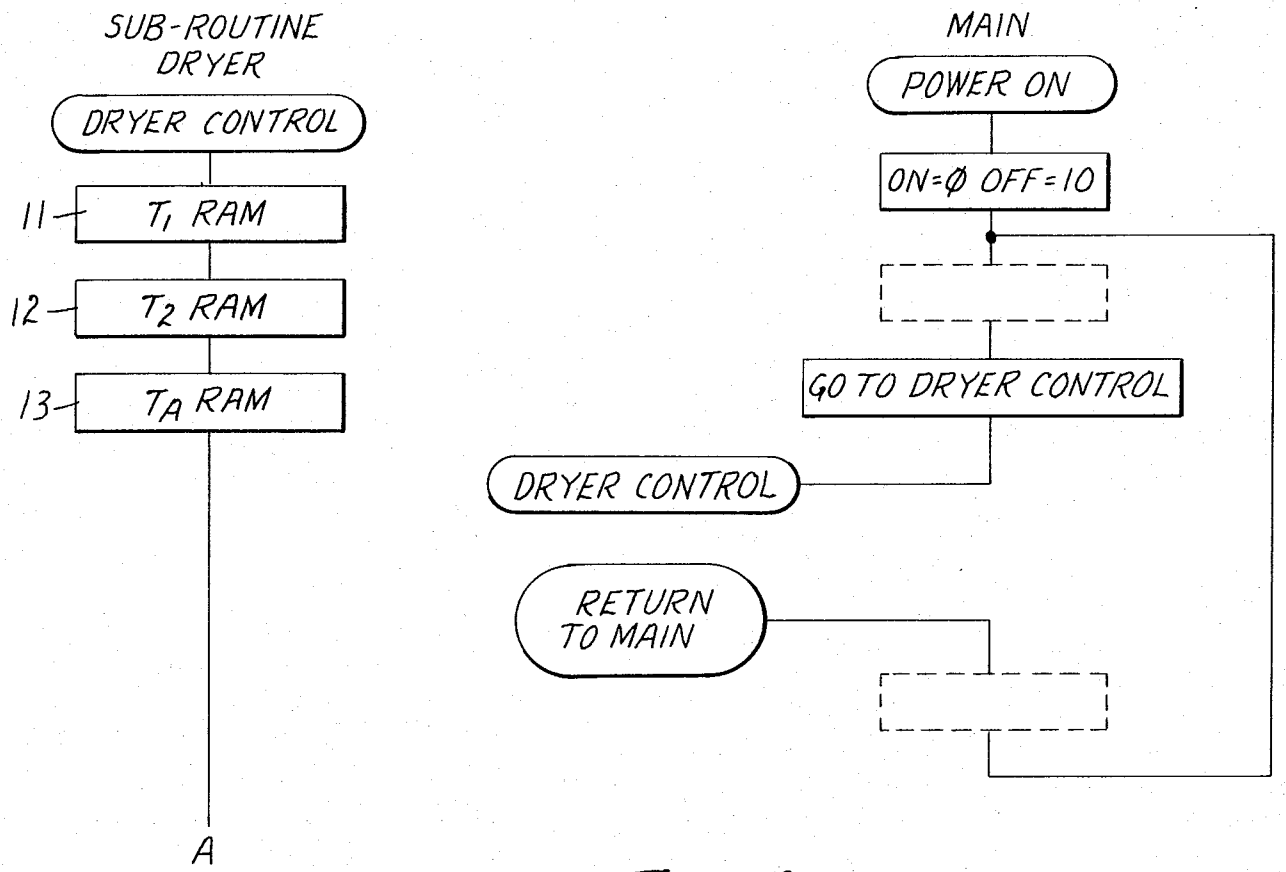
FIGS. 4 A, B and C show block diagrams of the memorized program of the microprocessor.
Figure 4B:
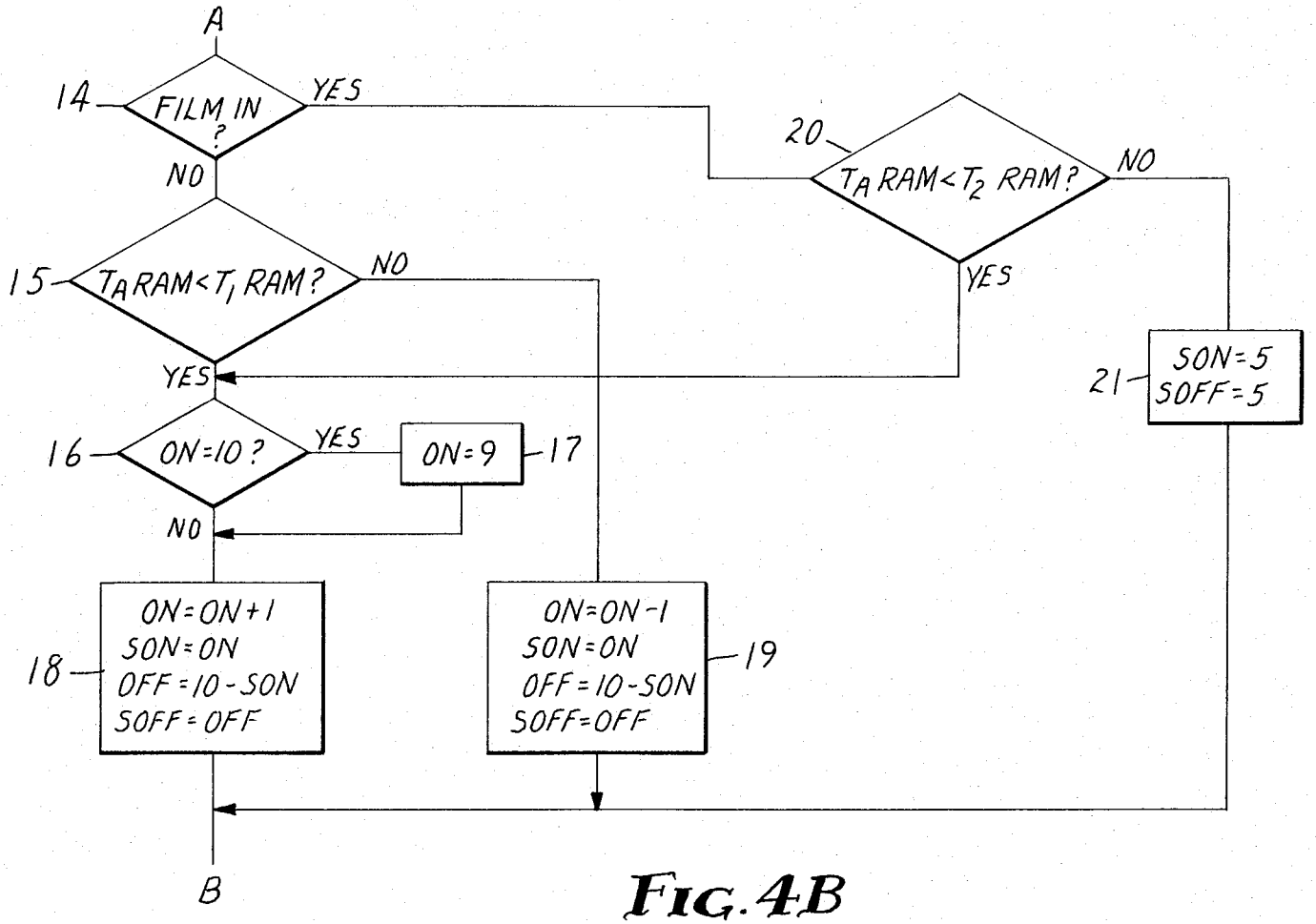
Figure 4C:
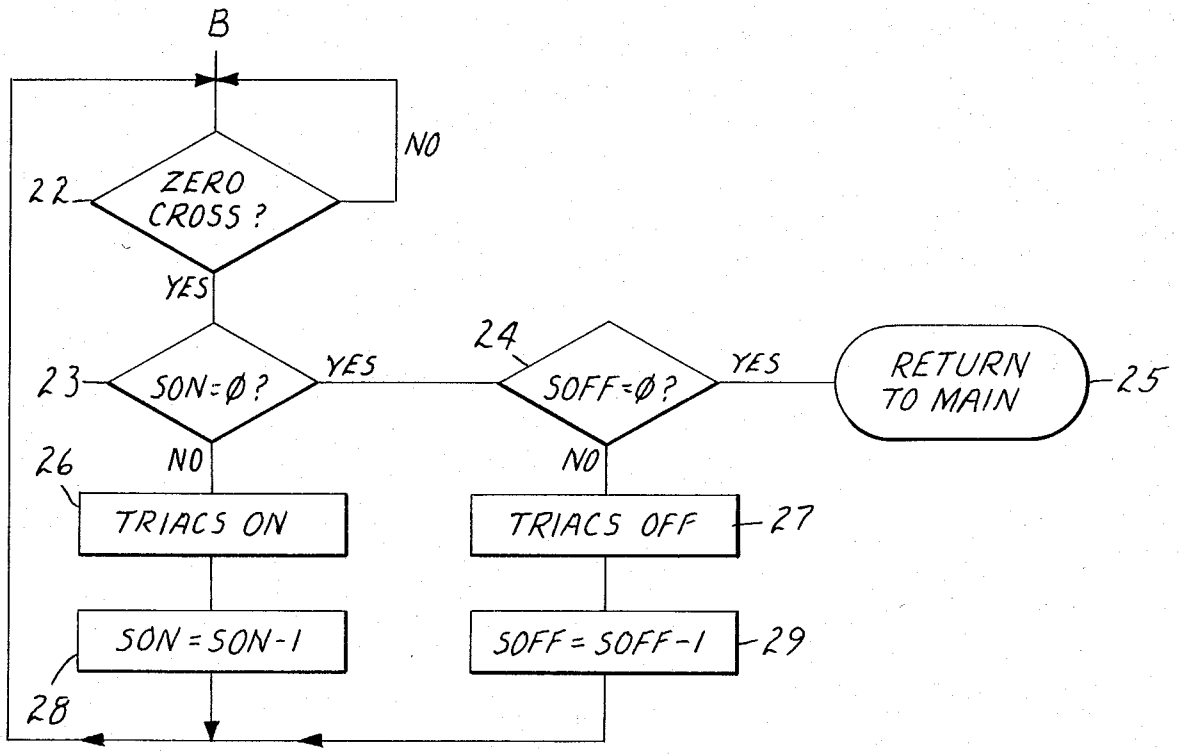

The machine was provided with means for effecting the block diagram of FIG. 3, which shows the following elements: the probe (S) for measuring the air temperature $T_A$ inside the drying chamber, which in the example is a Motorola MT 102; an amplifier (AMP) which adapts the sensor signal to the voltage level suitable for reception by the analog-digital converter in accordance with the equation $\Delta T=0°-64°$ C.$\rightarrow\Delta V_{ADC}\emptyset$-5 Volts; the combination of an input signal sampler (MPX) with an analog converter (ADC) which converts the signal from continuous to digital and is able to switch the various signals reaching it from different probes (including that under consideration) to the CPU, which in the example is a National Semiconductor ADC 0816; a (CPU) microprocessor which includes a memorised program as shown on the flow chart of FIG. 4, and which in the example is a Signetics 2650 AI CHIP; a zero crossing detector which informs the CPU when the main voltage passes through zero during the phase in which the derivative is positive, so that the TRIACS concerned are triggered at the moment of passage through zero; a driver which acts as an interface between the signals generated by the CPU and the power loads of the development section, and comprising Philips BT 137 TRIACS in the example; and a photo-reader for the inlet film, connected to the microcomputer and consisting of an area measurer comprising a set consisting of 43 Siemens LD 271 phototransmitters at a distance of 10 mm from each other and facing a like number of Siemens BP 103 BII photoreceivers at a distance of 8 mm. The device acts by transparency (the film is indicated by interruption of the signal which passes between the above phototransmitters and photoreceivers) and the signal indicating the presence of film in activated when at least three pairs of sensors are covered by the passing film. FIG. 4 describes the program effected by the aforesaid CPU, in terms of the relative flow chart which was translated into programming language suitable for the AI 2650 CHIP used, by using the instructions contained in the Signetics 2650 Manual and 2650 Assembler Language Manual, in a manner known to those ordinarily skilled in the art (in this respect, for completeness of information, reference can be made to the following Signetics publications: "Testware Instrument 2650 Assembly Language Manual Order No. TW 09005000"; "Operator's Guide TW 09003000"; "Signetic System Reference TW 9004000"). FIG. 4 shows the flow chart which illustrates the operation of the control sub-routine for the drying section. By means of a potentiometer, the operator selects the stand-by temperature $T_1$ on the machine control panel, and after analog-digital conversion, this is memorised in a RAM cell, $T_1$RAM. The operator also sets the drying section working temperature $T_2$, the digital value of which is memorised in a memory cell $T_2$RAM. The microprocessor measures the actual air temperature in the drying section $T_A$ and memorises this value in $T_A$RAM. If film is absent, the microprocessor cyclically compares the stand-by temperature $T_1$RAM with the memory cell $T_A$RAM according to the equation (1) $\Delta T = T_A\text{RAM} - T_1\text{RAM}$. If $\Delta T$ is greater than zero, the microprocessor keeps the IR lamps extinguished. If $\Delta T$ is less than zero, by sampling 10 main periods, the microprocessor lights the lamps in a gradual manner, beginning with 1 lamp supply period (on) and 9 interruption periods (off). At the next step, i.e. after 10 main periods, if the aforesaid situation remains ($\Delta T < 0$), the on/off relationship is modified, with 2 supply periods in 10, and so on in this manner. At a certain time t, the actual temperature $T_A$ of the drying section air will exceed the set stand-by temperature $T_1$, i.e. $T_A > T_1$. Let N (in this case equal to 10) be the number of sampling periods for controlling the lamps, $M_1$ the total of active periods, and $M_2$ the total of inactive periods, then (2) $M_1 + M_2 = N = 10$. Thus at said time t, (3) $M_1^t + M_2^t = N = 10$, where t is a whole multiple of main periods. At the next main period, (4) $M_1^{t+1} + M_2^{t+1} = N$. The microprocessor sets the relationships (5) $M_1^{t+1} = M_1^t - 1$ and (6) $M_2^{t+1} = M_2^t + 1$ until $T_A$ becomes less than $T_1$. If the system inertia against temperature changes is so high that the condition $T_A > T_1$ lasts for at least two seconds (corresponding to 10 cycle periods $t_c$ at 50 Hz), the microprocessor sets the lamp-extinguished conditions, i.e. $M_1 = 0$ and $M_2 = 10$ for successive steps in accordance with the aforesaid relationships (5) and (6). (It will be noted in this respect that any result of the relationship (5) which is less than zero is read as equal to zero, and any result greater than 10 is read as equal to 10, as indicated on the flow chart). If film is present, the microprocessor replaces the temperature $T_1$ with the temperature $T_2$ in the aforesaid relationships, but with the addition of the following constraint: for temperatures $T_A > T_2$, the relationship (7) $M_1 = k$ (in this case equal to 5) is valid. In the system considered, said constraint corresponds to the introduction of a minimum supply threshold equal to 10k percent (in this case 50 percent). The "dryer control" program has been described as sub-routine of a (not described in its details) main program set up for keep under control parts of the processing other than drying. Such dryer control program has the function, in the presence of film, to maintain a minimum power output in the lamps with additional energy supplied upon signaling that the temperature is lower than a minimum acceptable level ($T_2$). In absence of film the dryer control program has the function to supply the lamps with increasing energy when the temperature is lower than the set stand-by temperature ($T_1$) or with decreasing energy (progressively down to zero) when temperature is higher. The main program has been only described with respect to its sub-routine dryer control to particularly indicate that on switching on, which is the first step of said main program, the condition on=0 and off=10 is set. Such dryer control program works with numbers (E) equal to or greater than 1 responding to the following conditions $1+3=4$ and $0-E=0$. ON, OFF, SON, SOFF, T, RAM, $T_2$RAM, $T_A$RAM are memory cells containing the data in transit. SON and SOFF indicate, respectively, the on and off periods as memorized by the involved memory cell. The sub-routine program is divided substantially into a first data acquisition part, a second decision part depending on the presence or absence of film, and a third operational part. The program proceeds in accordance with the following sequence and with the alternative indicated: in Block 1, the system selects the analog channel for the $T_1$ setting (stand-by), it carries out the analog-digital conversion and memorises this digital value in the memory cell $T_1$RAM. Block 2 operates in a similar manner to Block 1, and $T_2$ is memorised in the memory cell $T_2$RAM. In Block 3, the analog channel for the temperature sensor for the air in the drying section is selected, the analog-digital conversion is carried out, and this value is memorised in the memory cells $T_A$RAM. In Block 4, by means of the inlet sensor, the microprocessor detects the presence or absence of film and keeps this state memorised for the entire machine cycle time (until the last inserted film leaves).

If film is absent, the program passes to Block 5, which checks whether $T_A\text{RAM} > T_1\text{RAM}$. If this condition is verified, it passes to Blocks 6 and 7, in which the condition that SON cannot have a value exceeding 10 is introduced. In Block 8, an increase of one for the lamp lighting time (on+1) is decided, with a corresponding decrease in the interruption time (off−1), and the values obtained with these variations (SON and SOFF) are memorised. In Block 12, the microprocessor awaits passage of the main voltage through zero. When this happens, it passes to Block 13, where a check is made on whether SON is equal to zero in the RAM cell. As seen in Block 8, this is not possible ($on = off + 1 \neq 0$). The program then passes to Block 16, where the loads, i.e. the lamps, are activated, and with them the fans (which are activated independently of the on/off relationship which controls the lamp power, and are deactivated when on is equal to zero). In Block 18, the SON memory cell is decreased by 1. The program then returns to Block 12 which acts as heretofore described, and then passes to Block 13 and so on. In Block 13, the cycle is repeated until the condition SON=0 is attained. When this condition is attained, the progral passes to Block 14, where a check is made on whether SOFF=0 in the RAM memory cell. If this condition is not verified, the program passes to Block 17 where the IR lamps are extinguished, and then to Block 19 where the SOFF memory cell is decremented by 1. It then returns to Block 12, from which it passes to Block 13*n* where SON=0 because nothing has happened to change this state. It then goes directly to Block 14. In this state, control passes to the main program. It should be noted that in Block 8 the condition SON+OFF=10 always exists, so that from the aforegoing description the IR lamps remain activated for a number of periods equal to SON and inactive for 10-SON periods. On the first passage through Block 8, SON will equal 1 and SOFF will equal 9. On the second passage, always assuming that the program originates from Blocks 5 and 6 (increase in temperature), SON will equal 2 and SOFF will equal 8. If requested by Blocks 5 and 6, the values SON=10 and SOFF=0 can be attained, corresponding to 100% power supply. An equilibrium condition will now be assumed such that $T_A$RAM≧$T_1$RAM, attained for example when SON=7 and SOFF=3, whereupon the program passes from Block 5 to Block 9. Under these conditions, SON is decreased by 1, SOFF is increased by 1, and the program then passes to Block 12. The situation already seen for SON=6 and SOFF=4 is repeated, and the program returns to the main program. This is repeated cyclically according to the conditions existing in Block 5. There will therefore be a modulation of the supply power in accordance with the aforegoing description (in the absence of film, SON can be equal to zero). If film is present, the decision Block 4 deviates the program towards Block 10, where the relationship $T_A$RAM<$T_2$RAM is checked. If this inequality exists, the progral passes to Block 8, to continue power modulation as already described. This situation remains while the aforesaid inequality is valid. When the condition $T_A$RAM≧$T_2$RAM is verified, the microprocessor deviates the program to Block 11, in which the permanent condition SON=5, SOFF=5 is set. Under these conditions, Blocks 6, 7 and 8 are excluded, and the program passes directly to Block 12 to supply the IR lamps with 50% of the total power. In effect, in the machine set up by the applicant, for safety reasons the cycle of 10 periods preferably comprises a fixed rest period so that the maximum available power is 90% of the theoretical (in the block diagram, at points 6 and 7, the condition "on=10?, on=9" was accordingly modified into the condition "on=9?, on=8"). Obviously, for experimental purposes, even though the SON value of Block 11 is equal to 5 in the example illustrated by the flow chart of FIG. 4 (i.e. the minimum threshold powder is equal to 50% of the available power), it can be given different values, such that the previously indicated general rules (of which in particular SOFF=10−SON) remain valid.

Figure 5:
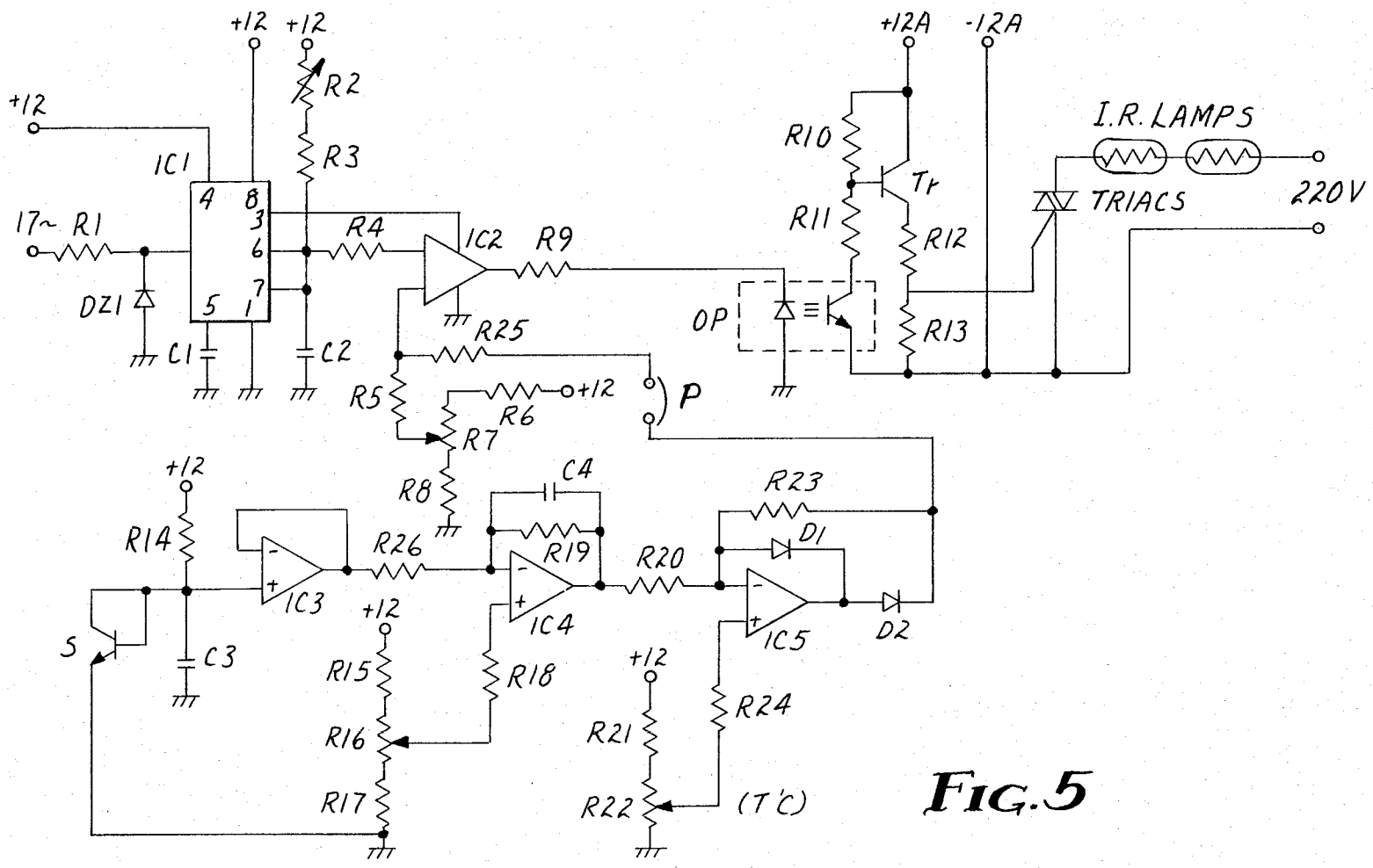
FIG. 5 shows an electrical schematic diagram of a control system.

FIG. 5 shows the electrical schematic diagram of a control system which operates in an analogous manner to the system of FIGS. 3 and 4, but which does not include a microprocessor. In this schematic, IC1 is a National Semiconductor NE555 integrated circuit, IC2, IC3, IC4 and IC5 are Motorola μ741 operational amplifiers, S is the Motorola MT 102 temperature probe, Dz1 is a Philips 9CV1 Zener diode, D1 and D2 are ITT 1N 914 diodes, OPI is a Fairchild 4N26 photoelectric isolator, TR is a National Semiconductors 2N 2905 transistor, and TRIAC is a Philips BT 137 triac. R indicates resistors and C indicates capacitors. IC1 operates as a monostable circuit. It starts on the negative front of the voltage present at pin 2 if pin 4 is kept at a positive supply voltage of 12 V. The duration of the monostable time is related to the time constant of the RC circuit. It is set equal to 10 main cycles, i.e. 200 ms (in the case of a frequency of 50 Hz). Remembering again the definitions for $t_{on}$ and $t_{off}$, it can be stated that $T_c=T_{on}+T_{off}$=200 milliseconds. At pin 6 of the IC1, there is a linear outlet voltage ramp which reaches its maximum value at t=200 ms, and begins when the main synchronism at pin 2 passes through zero. Pin 3 of IC1 supplies IC2, which is connected as a comparator with hysteresis between said ramp and the voltage present at the mobile contact of $R_7$. The position of said mobile contact determines the value of a minimum withdrawn power threshold. Assuming the bridge P is absent, the generated ramp supplies IC2, the output of which activates the optoisolator OP1 and controls the TRIACS which supply the IR lamps. This situation remains until the comparator IC2 becomes deactivated when the voltage withdrawn by the central R7 contact is less than the ramp voltage. When the ramp returns to zero, the output of IC2 remains at zero because it is without supply. This situation is repeated for the next negative front at pin 2 of IC1. Because the intrinsic property of the TRIAC is that it acts in half waves, it is possible to vary the IR power in steps of 5, each corresponding to one half wave in a total of 10 waves. If however it is assumed that the bridge P is connected, as is in fact the case, the probe S generates a voltage inversely proportional to the air temperature $T_A$. IC3 and IC4 are amplifiers in series such that IC4 has an output voltage such that $\Delta V=5-\emptyset\rightarrow T=0°-50°$ C. IC5 is connected as an amplifier and unit adder. If the temperature measured by the probe is greater than the working temperature set by R22, the output of IC5 becomes negative, and because of the presence of the diode at its output does not influence the lamp control circuit which remains supplied at the minimum power set by R7. If, on the contrary, such temperature is lower the output of IC5 gets positive by a quantity proportional to the temperature difference. The generated tension is additive with respect to the selected minimum power. Consequently, the lamps are supplied by the TRIACS, by way of IC2 and OP1, at a power determined by IC5 on the basis of the position of R22.

EXAMPLE 1

3M Medical X-ray Film Type R2 and 3M Medical X-ray Trimax Film XD were processed in the previously described machine of FIGS. 1, 2, 3 and 4, using 3M XAD 90/M solution for development, and 3M XF2 solution for fixing. Tests were carried out setting different minimum drying power threshold for the infra-red lamps, by choosing different values of SON and SOFF in Block 11 of the flow chart shown in FIG. 4. For the same experimental reasons, the temperature $T_1$ and $T_2$, namely the stand-by and working temperature, were varied as were the positions of the supplied lamps. In particular, an experiment (a) was carried out by putting SON equal to 2 in Block 11 of FIG. 4 (for a minimum power threshold of 20% of the available power), with 4 lamps supplied in pairs in positions L3, L4, L7 and L8, and with the temperatures $T_1$ and $T_2$ at 30° and 38° C. respectively. 3M type R2 radiographic films of format 30×120 cm were introduced into the machine. The drying section temperature reached the working temperature before the film entered it. During film passage, the infra-red lamps were seen to pulsate with color intensity. The films left the drying section with non-dry regions. On increasing the working temperature to 40° C., the type R2 films behaved in an entirely similar manner. Type XD films of the same format were also processed at the two temperatures, and at a temperature of 38° C. had zones of imperfect drying, although to a lesser extent, whereas at a temperature of 40° C. they showed a slight glazing in addition to imperfectly dry zones. On increasing the minimum power threshold to 30% (with SON equal to 3 in Block 11 of the flow chart of FIG. 4), the drying results improved for the XD (which could be dried at 38° C., without any of the glazing which was present at 40° C.), but not for the R2. On increasing the minimum power threshold to 50%, and fixing $T_2$ at 38° C., excellent results were obtained (complete drying without glazing) both with R2 and with XD films. Other tests at 50% minimum power threshold were carried out with the 4 lamps supplied in positions L2, L4,L6 and L8, and the stand-by temperature at 30° C. On fixing $T_2$ at 32° C., both types of film left the machine still moist. With $T_2$ at 35° C., the film XD emerged dry whereas the film R2 emerged moist. With $T_2$ at 38° C., both films emerged dry and free from glazing, whereas with $T_2$ at 40° C., XD was slightly glazed.

EXAMPLE 2

A stand-by temperature of 30° C. was set by electromechanical temperature control (of the type present in the XP510 processing machine of the applicant) in a XP 507 processing machine of the applicant (comprising 6 IR 400 W/110 V lamps supplied at 220 V in groups of 3 in series). The device of FIG. 5 was also fitted to the machine, and was operated by sensor means acting at the machine film inlet (said sensor means consisting of 3 phototransmitters applied to 3 photoreceivers analogous to those constituting the aforesaid photo-reader). The working temperature, measured by a thermometer at the probe, was set to a value close to 38° C. by means of the variable resistor R22. The minimum power threshold was set at 50% of maximim power by means of the variable resistor R7. On passing 3M radiographic films of type R2, XD and M through the machine, they emerged dry and free from glazing. Initial experimental data have also indicated the possibility of reducing the number of lamps from 6 to 4, supplied in pairs, thus giving a saving in machine costs.

The following is a list of values or meanings for symbols used in FIG. 5: R1=2.2 KΩ, R2=470 KΩ, R3=680 KΩ, R4=10 KΩ, R5=10 KΩ, R6=220Ω, R7=220Ω, R8=220Ω, R9=1.5 KΩ, R10=1 KΩ, R11=1 KΩ, R12=220Ω, R13=470Ω, R14=100 KΩ, R15=1.7 KΩ, R16=220Ω, R17=220Ω, R18=1.8Ω, R19=36 KΩ, R20=22 KΩ, R21=330Ω, R22=220Ω, R23=22 KΩ, R24=22 KΩ, R25=10 KΩ, R26=1.8 KΩ, C1=10 nF, C2=220 nF, C3=100 nF, C4=100 nF, DZ1=C9VI Philips, D1=1N 914 ITT, D2=IN 914 ITT, OP1=4N26 Fairchild, Tr=2N 2905 National, TRIAC=BT 137 Philips, IC1=NE 555 National, IC2=μ741 Motorola, IC3=μ741 Motorola, IC4=μ741 Motorola, IC5=μ741 Motorola, S=MT 102 Motorola.

EXAMPLE 3

The processor of Example 1, including the same processing baths, was set up with infrared lamps in $L_1$, $L_3$, $L_5$ and $L_7$ positions and minimum threshold power at 50 percent. The working temperature was set up at different values to dry a variety of x-ray films including 3M type R, 3M type XD and 3M type S films processed at various speeds. The following four temperature values (and corresponding drying times) allowed a good drying at four different corresponding speeds:

| | | | | |
|---|---|---|---|---|
| cm/sec | 1.0 | 2.0 | 2.4 | 3.2 |
| °C. | 30 | 35 ÷ 37 | 40 ÷ 42 | 44 ÷ 46 |
| sec | 42.0 | 21.0 | 17.5 | 13.1 |

As indicated, drying step in an x-ray processor is a part of the total processing including developing, fixing, washing and drying steps. The entire processing time is to be in modern X-ray processors less than 180 seconds, preferably less than 120 seconds. It is also required that such time can be changed by changing the speed of the film within the processor itself. While developing and fixing time can be significantly varied by small changes in the temperature (for example, a variation of 7° C., from 30° to 37° C. in the developing bath, and a variation of 2° C. in the fixing bath corresponding to a variation in speed from 1 to 3.2 cm/sec in the processor of Example 3), the drying time cannot be varied accordingly without causing significant deleterious effects on the film if the drying is not made as per the present invention.

A processor including the dryer of the present invention can perform smooth drying of a radiographic film in a time which goes from 50 to 10 seconds with a corresponding temperature variation of less than 25° C. without using temperature values significantly higher than 50° C.

Preferably, a processor of the present invention includes a dryer, as described, performing drying in a time of from 12 to 45 seconds at a working temperature of 50° to 30° C., more preferably in a time of less than 22 seconds at a temperature of 35° to 40° C.

Of course, single values of temperature within such limits are to be chosen dependent on drying time, lower values of time corresponding to higher temperature values. Analogously, for each drying time, temperature can be chosen lower within the indicated range if films having high water content are not to be processed.

If we take as a reference point 3M film type S, having a water content higher than other 3M films available on the market (more precisely 32 to 35 grams per square meter while 3M film type R and XD have water content of, respectively, 29÷30 and 23÷25 grams per square meter) a drying time of about 20 seconds is sufficient to dry it at a temperature of about 38° C. If we take as a reference 3M film type M, having a water content of 15 to 16 grams per square meter, a temperature and/or time values significantly less than the above ones would be enough for drying. It is normal in the art, however, to set up drying conditions for processing, dry to dry, each film present in the market. Particular exigiencies will be easily met, as described, from time to time, by the skilled artisan when performing film drying as per the present invention.

I claim:

1. An apparatus for drying a photographic film impregnated with water, which comprises a drying chamber provided with an inlet and an outlet, conveying means at least partially placed inside said chamber, infrared radiation sources of elongated shape turned towards the film conveying plane and means for the circulation of air at the actual working temperature inside said drying chamber, characterized in that said apparatus includes:

(a) means to measure the temperature of the air circulating inside the drying chamber;

(b) means to vary the electric power applied to the infrared ray sources;

(c) means which, dependent upon the result of said measurement of the air temperature, increase or decrease said applied power if the temperature is respectively found to be lower or higher than a predetermined value, the lamp power decrease variation, in the presence of a film to be dried, being unable to reach a value lower than a given minimum power threshold which, combined with the air at the actual working temperature, is capable of providing for the drying of the film.

2. The apparatus of claim 1, wherein said predetermined drying temperature is in the range from 35° to 40° C.

3. An apparatus as per claim 1 or 2, wherein the total power of the infrared lamps is selected such that said minimum power threshold applicable thereto in the presence of a film to be dried corresponds to a value in the range from 30 to 80 percent of their maximum power.

4. Photographic film processing machine which includes a plurality of water processing units for said films and a further drying unit, characterized in that said drying unit consists of the apparatus as per claim 1.

5. A processing machine as per claim 4, characterized in that said processing machine is provided with means to give the air a predetermined stand-by temperature lower than the working temperature of a value which can be reached through infrared ray heating while the film is conveyed from the outlet of said inlet towards the drying apparatus.

6. Photographic film processing machine which includes a plurality of water processing units for said films and a further drying unit, characterized in that said drying unit consists of the apparatus as per claim 2.

7. A processing machine as per claim 6, characterized in that said processing machine is provided with means to give the air a predetermined stand-by temperature lower than the working temperature of a value which can be reached through infrared ray heating while the film is conveyed from the inlet towards the outlet of said drying apparatus.

8. Photographic film processing machine which includes a plurality of water processing units for said films and a further drying unit, characterized in that said drying unit consists of the apparatus as per claim 3.

9. A processing machine as per claim 8, characterized in that said processing machine is provided with means to give the air a predetermined stand-by temperature lower than the working temperature of a value which can be reached through infrared ray heating while the film is conveyed from the inlet towards the outlet of said drying apparatus.

* * * * *